US007329214B1

(12) United States Patent
Norman

(10) Patent No.: US 7,329,214 B1
(45) Date of Patent: Feb. 12, 2008

(54) STOMACH EXERCISING APPARATUS AND METHOD

(76) Inventor: Donald Norman, 205 E. Talmer Ave., North Judson, IN (US) 46366

( * ) Notice: Subject to any disclaimer, the term of this patent is extended or adjusted under 35 U.S.C. 154(b) by 37 days.

(21) Appl. No.: 11/287,125

(22) Filed: Nov. 28, 2005

(51) Int. Cl.
*A63B 26/00* (2006.01)

(52) U.S. Cl. ..... 482/140; 482/907

(58) Field of Classification Search ..... 482/140, 482/907, 148, 23; 602/64; 128/134, 845, 128/869, 96.1, 876, 873; D21/686–687; D24/188, 190; 600/38
See application file for complete search history.

(56) References Cited

U.S. PATENT DOCUMENTS 4,396,013 A 8/1983 Hasslinger
4,602,782 A * 7/1986 Carlson ..... 482/140
D333,193 S 2/1993 Archambault
5,626,549 A * 5/1997 Olschansky et al. ..... 482/142
5,823,924 A 10/1998 Summers
5,913,757 A 6/1999 Winters
6,152,865 A 11/2000 Beauvoir
2004/0082449 A1 4/2004 Brown, Jr.

* cited by examiner

*Primary Examiner*—Lori Amerson

(57) ABSTRACT

A stomach exercising method includes an elongated strap that has a first end, a second end, a first side and a second side. A coupler releasably couples the first end to the second end to define a loop. A grip is attached to the first side of the strap. The strap is wrapped around a person's leg above a knee of the leg and a loop is formed with the coupler. The grip is positioned adjacent to a thigh muscle of the leg and faced away from the leg. The person grips the handle while the person is positioned on their back. The person lifts their leg upwardly with the grip and performs sit-up movements.

6 Claims, 2 Drawing Sheets

STOMACH EXERCISING APPARATUS AND METHOD

BACKGROUND OF THE INVENTION

1. Field of the Invention

The present invention relates to stomach exercising devices and more particularly pertains to a new stomach exercising device for aiding a person while they do sit ups to prevent injuries to their lower back.

2. Description of the Prior Art

The use of stomach exercising devices is known in the prior art. While these devices fulfill their respective, particular objectives and requirements, the need remains for a method that assists a person in lifting their tailbone off of a floor surface to prevent injuries to their lower back while they perform sit-up motions. The method may also be used to assist a person in lifting their body off of a floor surface while doing sit ups.

SUMMARY OF THE INVENTION

The present invention meets the needs presented above by generally comprising an elongated strap that has a first end, a second end, a first side and a second side. A coupler releasably couples the first end to the second end to define a loop. A grip is attached to the first side of the strap. The strap is wrapped around a person's leg above a knee of the leg and a loop is formed with the coupler. The grip is positioned adjacent to a thigh muscle of the leg and faced away from the leg. The person grips the handle while the person is positioned on their back. The person lifts their leg upwardly with the grip and performs sit-up movements.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
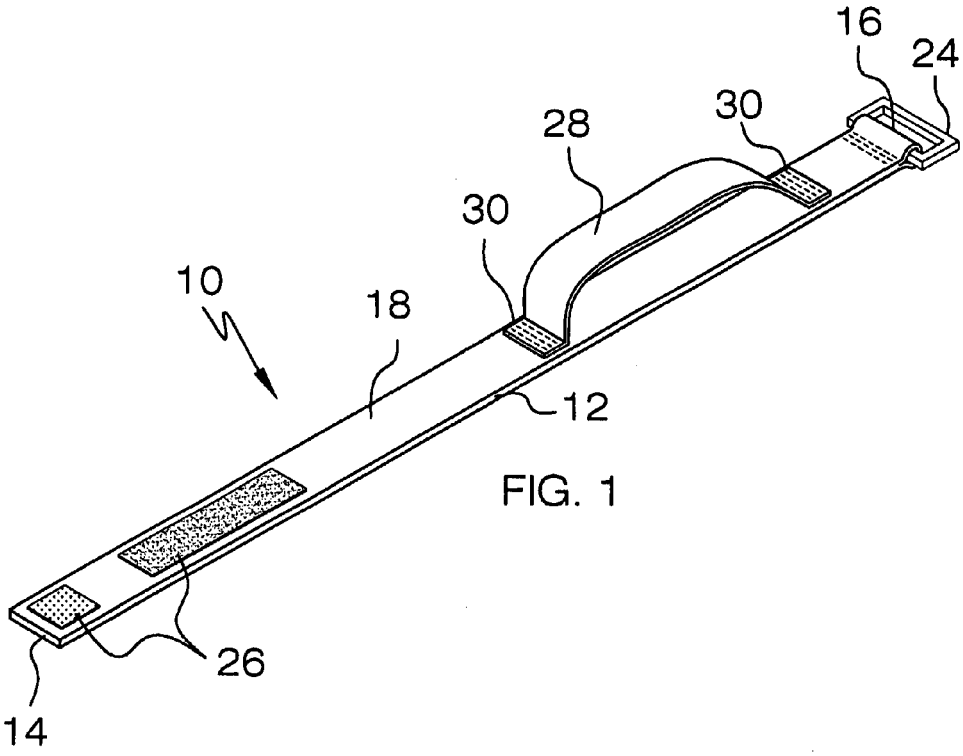
FIG. 1 is a perspective view of a stomach exercising apparatus and method according to the present invention.
Figure 2:
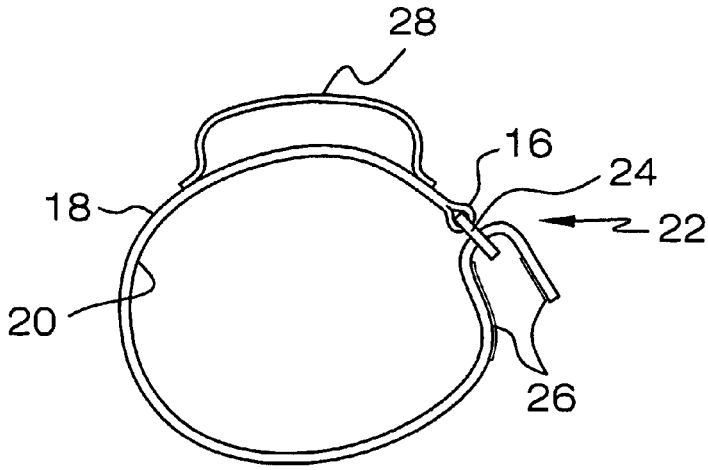
FIG. 2 is a side view of the present invention.
Figure 3:
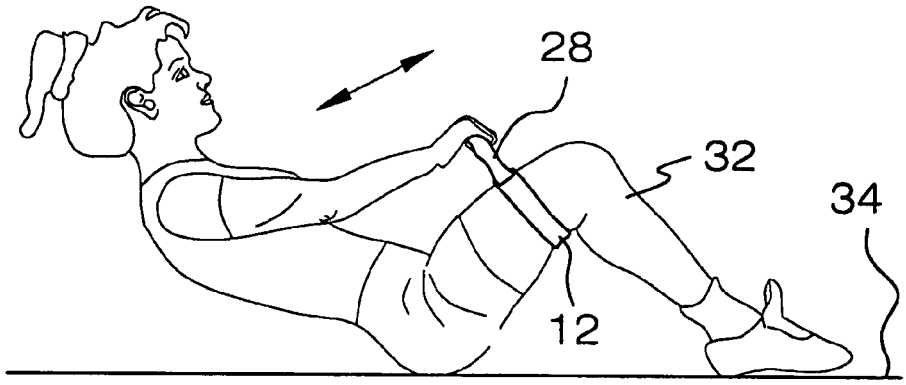
FIG. 3 is a side in-use view of the present invention.
Figure 4:
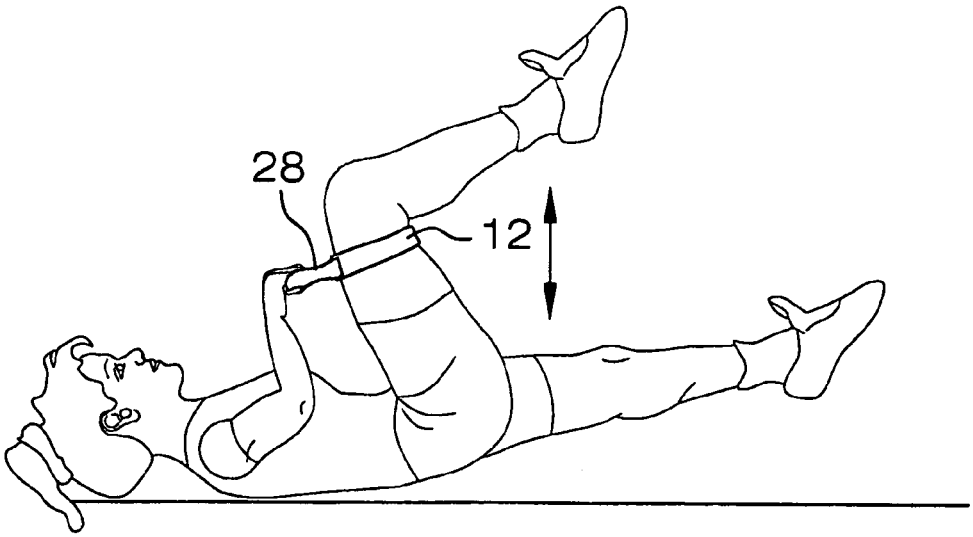
FIG. 4 is a side in-use view of the present invention.

With reference now to the drawings, and in particular to FIGS. 1 through 4 thereof, a new stomach exercising device embodying the principles and concepts of the present invention and generally designated by the reference numeral 10 will be described.

As best illustrated in FIGS. 1 through 4, the stomach exercising apparatus and method 10 generally comprises providing an elongated strap 12 that has a first end 14, a second end 16, a first side 18 and a second side 20. A coupler 22 releasably couples the first end 18 to the second end 20 to define a loop. The loop has a selectively adjustable perimeter length. The coupler 22 includes a ring 24 attached to the second end 16 of the strap 12 and a fastener 26 configured for releasably attaching portions of the first side 18 together after the first end 14 has been extended through the ring 24. The ring 24 preferably may have a rectangular shape or be D-shaped. The fastener 26 comprises a hook and loop fastener. The strap 12 has a length generally between 24 inches and 36 inches.

A grip 28 is attached to the first side 18 of the strap 12. The grip 28 is positioned nearer to the second end 16 than the first end 14. The grip 28 is elongated and has a pair of opposing ends 30. Each of the opposing ends 30 is attached to the strap so that the grip 28 is aligned with a longitudinal axis of the strap 12. The grip 28 is comprised of a flexible material.

In user, the strap 12 is wrapped around a person's leg 32 above a knee of the leg 32. A loop is formed with the coupler 22. The grip 28 is positioned adjacent to a thigh muscle of the leg 32 and is faced away from the leg 32. The person then grips the handle 28 while the person is positioned on their back. The leg 32 is lifted upwardly with the grip 28 to lift the person's tailbone off of a floor surface 34 and the person then performs sit-up movements to exercise the stomach muscles. Alternatively, the grip 28 may be used to aid a person in lifting their back off of the floor surface 34 while their feet remain on the floor surface 34.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of exercising abdominal muscles, said method comprising the steps of:

providing an elongated strap having a first end, a second end, a first side and a second side, a coupler releasably coupling said first end to said second end to define a loop;

providing a grip being attached to said first side of said strap;

wrapping said strap around a person's leg above a knee of the leg;

forming a loop with said coupler;

positioning said grip adjacent to a thigh muscle of the leg and facing said grip away from the leg;

gripping said grip by the person while the person is positioned on their back; and lifting the leg upwardly with the grip and performing sit-up movements by the person.

2. The method according to claim 1, wherein the step of providing an elongated strap further includes said loop having a selectively adjustable perimeter length.

3. The method according to claim 2, wherein the step of providing an elongated strap further comprises said coupler including a ring attached to said second end of said strap and a fastener configured for releasably attaching portions of said first side together after said first end has been extended through said ring.

4. The method according to claim 3, wherein the step of providing an elongated strap further includes said fastener comprising a hook and loop fastener.

5. The method according to claim 1, wherein the step of providing a grip further includes said grip being positioned nearer to said second end than said first end, said grip being elongated and having a pair of opposing ends, each of said opposing ends being attached to said strap such that said grip is aligned with said strap.

6. A method of exercising abdominal muscles, said method comprising the steps of:

providing an elongated strap having a first end, a second end, a first side and a second side, a coupler releasably coupling said first end to said second end to define a loop, said loop having a selectively adjustable perimeter length, said coupler including a ring attached to said second end of said strap and a fastener configured for releasably attaching portions of said first side together after said first end has been extended through said ring, said fastener comprising a hook and loop fastener, said strap having a length generally between 24 inches and 36 inches;

providing a grip being attached to said first side of said strap, said grip being positioned nearer to said second end than said first end, said grip being elongated and having a pair of opposing ends, each of said opposing ends being attached to said strap such that said grip is aligned with said strap, said grip being comprised of a flexible material;

wrapping said strap around a person's leg above a knee of the leg;

forming a loop with said coupler;

positioning said grip adjacent to a thigh muscle of the leg and facing said grip away from the leg;

gripping said grip by the person while the person is positioned on their back; and lifting the leg upwardly with the grip and performing sit-up movements by the person.

* * * * *